US006760933B2

(12) United States Patent
Li

(10) Patent No.: US 6,760,933 B2
(45) Date of Patent: Jul. 13, 2004

(54) CUSHION DEVICE FOR BATH OR HOT TUB

(76) Inventor: Conghua Li, 112-550 Queen's Quay West, Toronto, Ontario (CA), M5V 3M8

( * ) Notice: Subject to any disclaimer, the term of this patent is extended or adjusted under 35 U.S.C. 154(b) by 0 days.

(21) Appl. No.: 10/313,269

(22) Filed: Dec. 9, 2002

(65) Prior Publication Data

US 2003/0131406 A1 Jul. 17, 2003

Related U.S. Application Data

(60) Provisional application No. 60/347,484, filed on Jan. 11, 2002.

(51) Int. Cl.[7] ..... A47K 3/622

(52) U.S. Cl. ..... 4/578.1; 4/579; 4/575.1; 4/571.1; 4/573.1

(58) Field of Search ..... 4/575.1, 571.1, 4/573.1, 577.1, 578.1, 579; 5/643, 630, 644, 645, 647

(56) References Cited

U.S. PATENT DOCUMENTS 2,582,439 A * 1/1952 Kavanagh ..... 297/396
4,037,591 A * 7/1977 Sarno ..... 601/57
4,389,742 A * 6/1983 DeWitt ..... 5/654
4,445,240 A * 5/1984 Voorhees ..... 5/655.5
4,724,560 A * 2/1988 Christie ..... 5/644
5,642,544 A * 7/1997 Munoz ..... 5/644
6,401,279 B1 * 6/2002 Vaughn ..... 5/644

* cited by examiner

*Primary Examiner*—Henry Bennett
*Assistant Examiner*—Azadeh Kokabi

(57) ABSTRACT

A cushion device for use when at least partially submerged in the water of a bath, a hot tub or the like, comprising a flexible hollow, enclosed shell having upper and lower ends, and being capable of containing liquid without substantial leakage, and having a plurality of ports that can allow gas or liquid to enter into or to escape from the shell, the ports being provided with closure means which can substantially prevent entry and escape of gas or liquid from the shell. The shell is capable of maintaining a substantial volume by virtue of a spacing device or its own inherent firmness, rigidy or stiffness, when the shell is open to ambient water or air pressure, and further comprises a weight tending to hold the lower end of said device in a position below said upper end when the device is submerged or partially submerged. The device is designed to fill automatically with water while a bathtub is being filled.

10 Claims, 4 Drawing Sheets

CUSHION DEVICE FOR BATH OR HOT TUB

This application claims priority from U.S. Provisional Application No. 60/347,484 filed Jan. 11, 2002

FIELD OF INVENTION

This invention relates to cushion or pillow devices for the comfort of persons while bathing in various bathtubs, hot tubs or the like, especially to such devices that support bathers' lumbar regions instead of necks or shoulders only. Since the primary purpose of the invention is support of the lower back, the device will hereinafter be referred to as a "cushion" or "cushion device".

DISCUSSION OF PRIOR ART

No matter how well designed, bathtub contours are usually too rigid to provide adequate support to bathers' lumbar regions and to allow comfortable sitting or lying in bathtubs. Also, most bathtubs provide a triangular hollow space between bathers' lumbar or lower back regions and the walls of the bathtubs, which causes significant discomfort especially to persons with lumbar or lower back pain or the like.

Most related products are pillows designed to support bathers' shoulders and necks only. By doing so, they elevate bathers' bodies and enlarge the hollow space between their backs and the walls of bathtubs, hence making the problem worse. Examples of such products are shown in the following U.S. patents:

U.S. Pat. No. 5,014,373, issued May 14, 1991 to Dobine, and

U.S. Pat. No. 5,140,713, issued Aug. 25, 1992 to Pesterfield.

Some products which do provide a certain degree of support for the back regions lack adequate mass to fill up the triangular hollow space to support persons' lower backs and are inherently buoyant, and therefore require firm fixing in the bath, for example by means of suction cups, and lack adequate maneuverability which is critical for a comfortable support. Such products are shown, for example, in the following U.S. patents:

U.S. Pat. No. 2,483,077, issued Sep. 27, 1949 to Walsh,

U.S. Pat. No. 2,582,439, issued Jan. 15, 1952 to Kavanagh, and

U.S. Pat. No. 3,078,474, issued Feb. 26, 1963 to Chaitlen.

Also known are water-filled pillows, or pillows which may be partly filled with water or other liquid, and which are designed for regular, i.e. non-bath, use, and which function somewhat similarly to water beds. These devices usually have only a single inlet/outlet port or opening and are not easy to fill, and are difficult to handle and to transport from a water source to a desired cushion location, especially when an adequate support is aimed and the required water mass is large and heavy. Such pillows are shown in the following U.S. patents:

U.S. Pat. No. 3,900,910, issued Aug. 26, 1975 to Nakata;

U.S. Pat. No. 4,724,560, issued Feb. 16, 1988 to Christie;

U.S. Pat. No. 4,896,388, issued Jan. 13, 1990 to Bard; and

U.S. Pat. No. 5,642,544, issued Jul. 1, 1997 to Munoz.

The present invention is designed to provide sufficient and ergonomic lumbar support to persons while sitting or lying in bathtubs, hence to improve their bathing comfort and relaxation, while maintaining an adequate level of maneuverability, handleability and transportability of the supporting device.

OBJECTS OF THE INVENTION

Accordingly, it is an object of the invention to provide sufficient and easily maneuverable support to bathers' lumbar or lower back regions underwater to allow them to maximize health and therapeutic benefits of bathing.

It is another object of the invention to provide a cushion device allowing automatic filling and draining which avoids otherwise required complicated or awkward filling and transporting operations.

It is yet another object of the invention to allow simultaneous use of several of said cushion devices, due to the fact that said cushion device does not require firm fixing such as by means of suction cups, to obtain utmost lumbar support and comfort.

It is still another object of the invention to provide an esthetically pleasing decorative element for bathrooms.

Further objects and advantages of the invention will become apparent from a consideration of the ensuing description and drawings.

SUMMARY OF THE INVENTION

In accordance with one aspect of the invention, a cushion device for use when at least partially submerged in the water of a bath, a hot tub or the like, comprises:

a flexible hollow, enclosed shell having upper and lower ends, and being capable of containing liquid without substantial leakage, and a plurality of ports for allowing gas or liquid fluid to enter into or to escape from said shell, said ports being provided with closure means for substantially preventing said entry and escape of gas or liquid from the shell, wherein said shell is capable, by virtue of its sufficient stiffness, rigidity or firmness, of maintaining a substantial volume when the shell is open to ambient water or air pressure via said ports.

The cushion device preferably further comprises weight means so that, at the beginning of the automatic filling process, the weight means tends to hold the lower end of said device at the bottom of said bathtub or the like to facilitate said filling process, and so that when the device is in water the weight means tends to hold the lower end of said device in a position below its upper end.

The shell may include spacing means for maintaining the volume of the shell when the ports are open to ambient water or air pressure. The spacing means may be a structure comprising a plurality of cylinders made of mesh polymer material, this material allowing free flow of gas and liquid fluid between the outside and the inside of said cylinders.

The ports of the shell may include upper and lower ports arranged so that, when rising water is filling the shell through a lower port or a plurality of lower ports, air is being vented from an upper port or a plurality of upper ports. Preferably, the ports are mounted on said shell near both its upper and lower ends to avoid fluid-trapping dead spots inside said cushion.

The shell is preferably a flexible container made of polymer material by means of a technology selected from the group consisting of heat sealing, welding, adhesive bounding, blow molding, rotational molding, vacuum forming or injection molding.

According to another aspect of the invention, a method for providing cushioning support under liquid in a confined basin such as a bath, comprises the steps of:

providing a cushion device in the form of a flexible hollow shell which is such as to maintain an expanded condition when its interior is open to ambient air or liquid pressure, said shell having a plurality of ports each provided with a closure means;

placing said device at the bottom of said basin when said basin is empty, with at least one of said plurality of ports near an upper end of said shell and at least one of said plurality of ports near a lower end of said shell, and with at least one upper and at least one lower of said ports being kept open, filling said basin with liquid while said liquid enters said device automatically through at least one port near the lower end of said device while gas is pushed out of said device through at least one said port near the upper end of said device, and closing all said ports once said basin is filled up to a desired level, whereby said device is filled automatically as the basin is being filled, and becomes ready for use.

After use, at least one upper and at least one lower ports is opened to allow said device to be drained while said basin is being drained after use and if desired, whereby said device is ready for another cycle of use.

BRIEF DESCRIPTION OF THE DRAWINGS

Preferred embodiments of the invention will now be described with reference to the accompanying drawings, in which.

DETAILED DESCRIPTION

Figure 1:
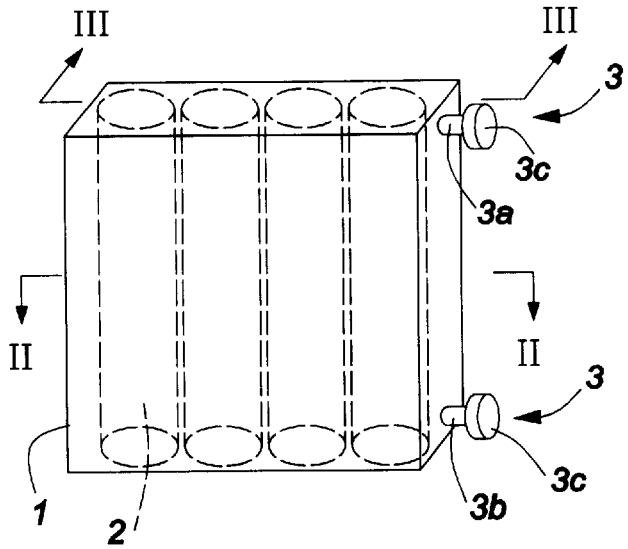
FIG. 1 is a perspective view of the cushion device, without any pillowcase-type cover.
Figure 3:
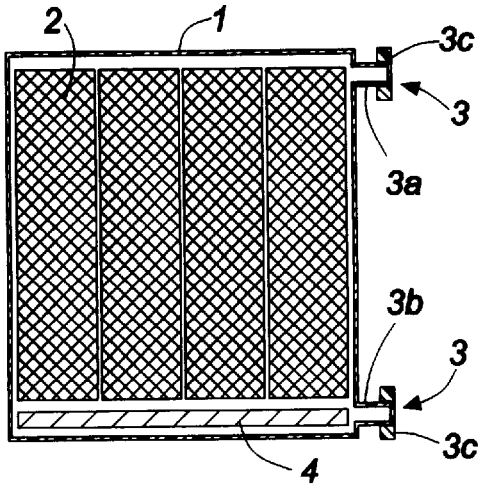
FIG. 3 shows a longitudinal section of the cushion device on lines III—III of FIG. 1.

FIG. 1 is an illustration of a first embodiment of the cushion device without a cover of the pillowcase type; this will be referred to as the "core" of the device. The core consists of a flexible hollow shell 1, spacing means 2 within the shell, and a plurality of protruding, tubular fluid control ports 3. These ports include an upper inlet/outlet fitting 3*a* near the upper end of the core, and a lower inlet/outlet fitting 3*b* near the lower end of the core, each fitting having a closure means 3*c*. Also, as seen in FIG. 3, the core incorporates weight means 4 in its base.

The flexible hollow shell 1 is made of a flexible and water-proof material and is mounted with the port fittings 3*a* and 3*b*, and is watertight when the ports are closed by the closure means 3*c*. The ports allow water to enter the core and, once closed in, to provide desired body supporting function, and the contained water keeps the cushion at the bottom of a bathtub and at positions desired by users, instead of floating on the water surface or escaping from the desired position when the user moves and releases pressure on top of the cushion.

The spacing means 2 is made of a flexible, elastic and durable polymer material for example in the form of a net or mesh. In the embodiment shown the material is shaped into cylinders. The spacing means 2 keeps the cushion in an aesthetically pleasant and expanded form when not filled with water, which is critical for the automatic filling and draining feature of said cushion.

The fluid control ports 3 comprise two water and air-tight fittings 3*a* and 3*b* with sufficient openings for easy filling with water, and closure means 3*c* linked to the port fittings for easy handling. These ports are designed to fill the cushion with water to:

provide cushioning support to persons' lumbar or lower back regions;

keep the cushion at the bottom of a bathtub and at a position desired by users;

provide adjustable softness or firmness and ergonomic shape of the cushion to allow optimal comfort, and to allow automatic filling and draining of the cushion.

The upper port fitting 3*a* near upper end may alternatively be placed at the top of the cushion, instead of at its side, to allow better filling and draining of water and air. For the same purpose, the lower port fitting 3*b* may be placed at the bottom of the cushion, instead of at the side.

Figure 2:
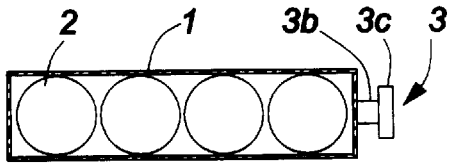
FIG. 2 shows a cross section of the cushion device on lines II—II of FIG. 1.

The weight means 4 assure that the cushion stays at the bottom of the bathtub during the initial filling process, FIG. 2 shows a cross section of the cushion core, and shows the placement of the spacing means 2. The four cylinders which comprise the spacing means are positioned in close side-by-side parallel relationship.

Figure 2A:
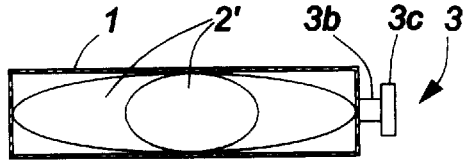
FIG. 2*a* shows a similar section through a variation of the cushion device.

FIG. 2*a* shows a cross section of a variation of the cushion core, and shows the placement of the spacing means 2'. The spacing means comprise two flattened cylinders which are positioned one-in-the-other in parallel relationship.

FIG. 3 shows a vertical section of the cushion core, showing the placement of spacing means 2 and the port fittings 3*a* and 3*b* as well as closure means 3*c*. It also shows the weight means 4 in the form of a bar extending underneath the spacing means and tied down to the bottom of the shell.

Figure 3A:
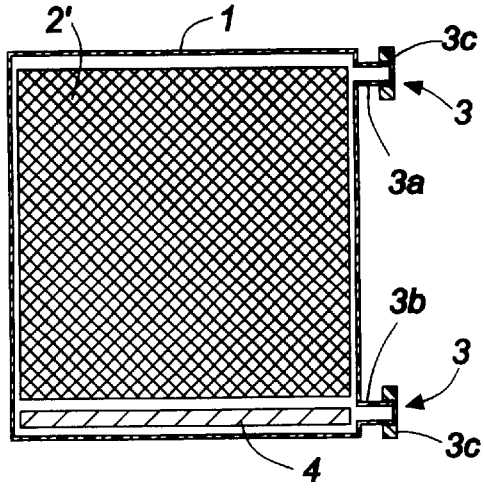
FIG. 3*a* shows a similar view of the variation shown in FIG. 2*a;*

FIG. 3*a* shows a vertical section of a variation of the cushion core, showing the placement of spacing means 2' and the port fittings 3*a* and 3*b* as well as closure means 3*c*. It also shows the weight means 4 in the form of a bar extending underneath the spacing means and tied down to the bottom of the shell.

Figure 4:
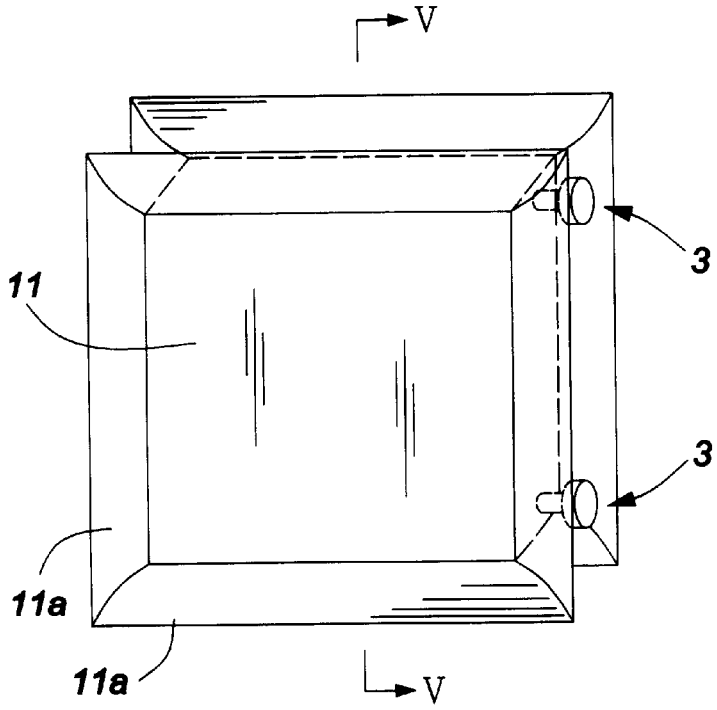
FIG. 4 shows a front view of a slight variation the cushion device shown in FIG. 1.

FIG. 4 shows a slight variation of the cushion core, in which the two major face sheets 11 of the flexible enclosed shell have extensions 11*a* to make the cushion look like a conventional bed or couch cushion. This is mainly for aesthetic purposes.

Figure 5:
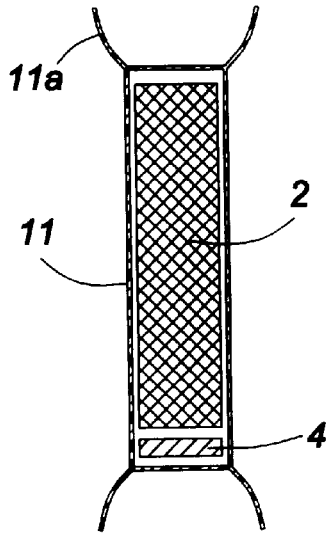
FIG. 5 shows a cross section of the same form of the device on lines V—V of FIG. 4.

FIG. 5 shows a cross section of the same variation, and shows the placement of the spacing means 2 and weight means 4.

The cushion so far described can be used on its own, or can be fitted into a pillowcase type cover 5 which can be safely submerged in water.

Figure 6:
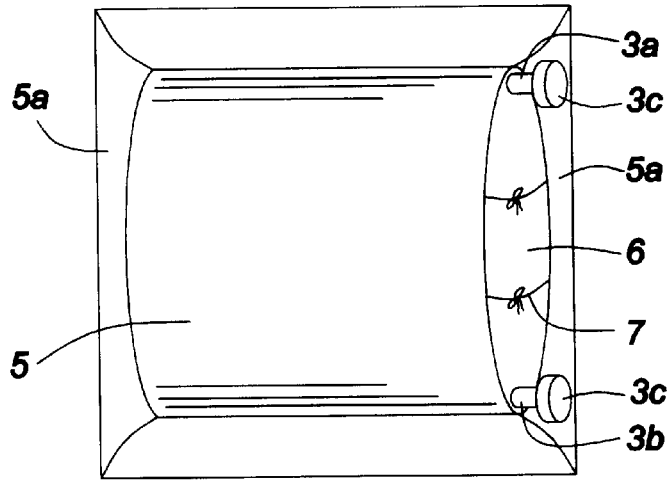
FIG. 6 shows a back view of a pillowcase-type cover with the cushion device inside it.

FIG. 6 shows the cover 5 with the cushion core inside it, this being a view from the back of the cover 5. The cover 5 is designed to provide a skin-friendly and comfortable underwater 'touch and feel' and to provide decorative pleasure in bathtubs and bathrooms. It also has special side openings 6 for easy insertion and removal of the core and allows easy access and operation of the port fittings 3*a* and 3*b* as well as closure means 3*c*. The openings 6 are tight and closed by strings 7, if desired. These openings lie behind the side extension 5*a* of the front of the cover 5.

Figure 7:
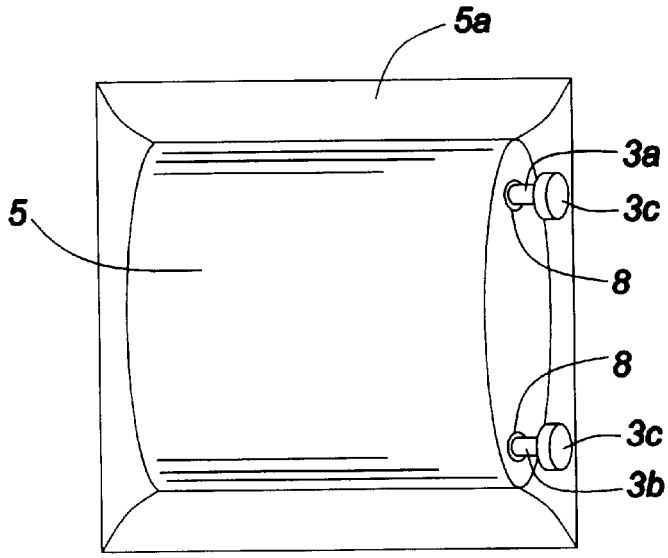
FIG. 7 shows similar back view of another variation of the cover with the cushion device inside it.

FIG. 7 shows a variation of cover 5 with the cushion core inside it, this being a view from the back of the cover. It has two openings 8 specially suited to the fluid control port fittings 3*a* and 3*b* for easy access and operation of the closure means 3*c*.

Operation

Figure 8:
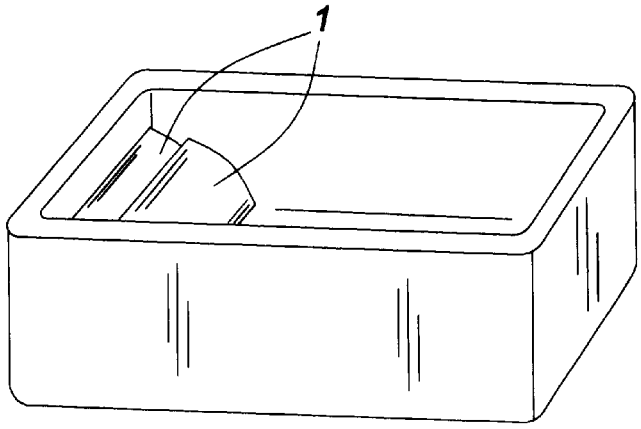
FIG. 8 is a perspective view of a bathtub with cushion devices of this invention inside.

The operation of the cushion device is similar to the way people use their cushions or pillows on their sofas or beds. For decorative purposes, one can simply place the cushion devices in a dry bathtub, as shown in FIG. 8.

Figure 9:
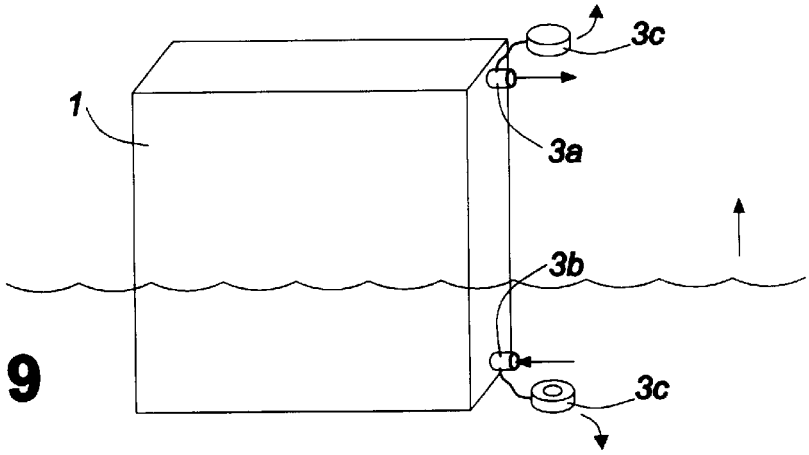
FIGS. 9, 10 and 11 are perspective views of a device in accordance with the invention in three successive positions.
Figure 10:
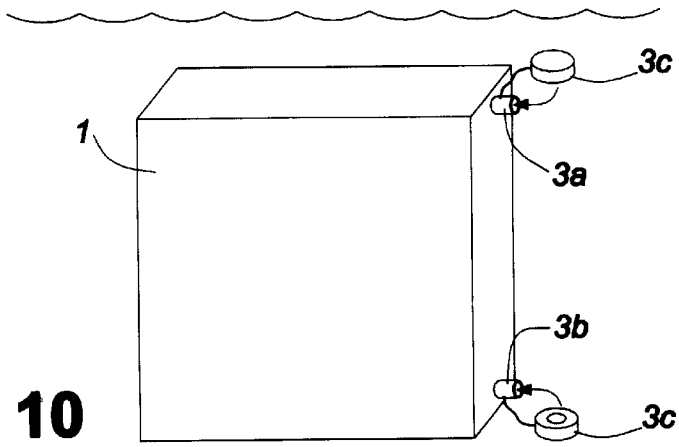
Figure 11:
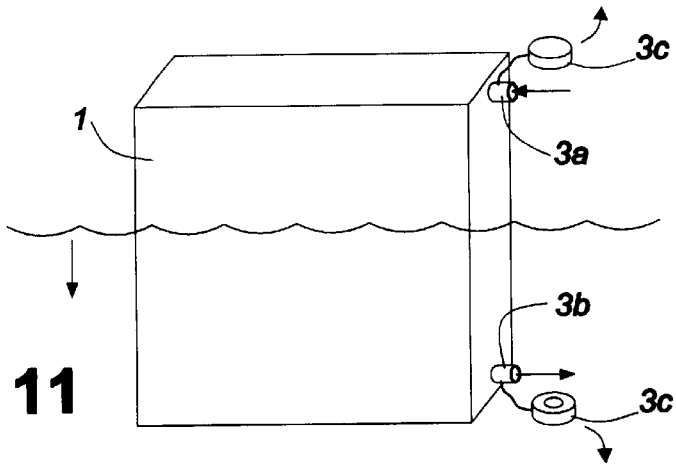

FIGS. 9, 10 and 11 illustrate respectively the filling process, the utility stage, and the draining process during the operation of the bath cushion device 1, as follows:

FIG. 9: simply place the cushion device in a dry bathtub with the heavier side to the bottom while keeping one of the fluid control ports 3 near upper end of said cushion and one of the ports 3 near the lower end of said cushion, and maneuver the closure means 3*c* to open the two ports 3. Then start to let water in to fill the bathtub, but avoid direct water jet impact on the cushion device. This will cause water automatically to enter the cushion device through the lower port fitting 3*b*, while existing air in the cushion device will be automatically pushed out through the upper port fitting 3*a*. As a result the cushion device is filled up automatically in synchron with the bathtub's filling process.

FIG. 10: when the tub is filled to a desired level, close both port fittings 3*a* and 3*b* with the closure means 3*c*. The cushion device is then ready to be used to support back, shoulders, arms, legs, feet, and any other part of one's body in the bathtub. One can open one of said ports 3 to control the amount of water in the cushion device, hence to control the degree of softness or firmness or the ergonomic shape of the device.

FIG. 11: after bathing, simply maneuver closure means 3*c* to open the two port fittings 3*a*, 3*b* near the upper and the lower ends of said cushion device, and start draining the bathtub. The water inside the device will automatically drain from the lower port fitting 3*b* while air enters the cushion device through the upper port fitting 3*a*; this assumes that an empty condition of the cushion device is desired. The device can also be kept in a filled condition for the next use. In this situation, it will be recommended to drain and replace the water in the device at least once a week.

When the bathtub is emptied, the cushion device can simply be rinsed and cleaned. If the device includes a cover, and the user desires, the cover can be taken off for washing or drying, and, if desired, the core can be dried with a dry towel or paper towel. When a fresh cover is back on the cushion device it is now ready to be placed in bathtub again for decorative and utility purposes.

Accordingly, it will be seen that the bath cushion device of this invention can be used to support a bathers' lumbar region sufficiently to improve the bathers' wellbeing, productivity, and overall quality of life. It can be filled and drained automatically without special effort. It is a low cost solution to dramatically improve health and therapeutic benefits of bath taking. While costing only a fraction of a spa treatment, it turns every bath taking into a rejuvenating spa experience.

Advantages

From the description above, a number of advantages of the invention become evident:

The device is likely to significantly improve people's bathing experience, potentially improve people's health, recreation, productivity, and quality of life;

Unlike other products, this invention provides strong support to the lower back (i.e. it has sufficient mass to fill the usual triangular hollow space) and hence greatly reduces the tensions not only in the lower back but also in the shoulder, neck areas and the entire body;

The device being suction-cup free and freely maneuverable underwater without tendency to float, allows usage of plural cushions in a bathtub to maximize support to a bather in a bathtub and further improve the health and therapeutic benefits of bath taking;

Being designed to remain in bathtubs when not in use, the device allows people to effectively bring color and design into bathtubs, which will translate traditionally clean but clinical bathtubs into a cozy oasis in people's homes;

The design of the cushion of the invention avoids the regularly required blowing up of air-inflatable pillows or cushions via the human mouth which is both cumbersome and unhygienic;

The design of the cushion of the invention avoids the required carrying of a filled cushion from a water source;

It maintains the temperature of the water inside the cushion longer than the bath water which usually cools down shortly after said tub being filled;

It allows the cushion to easily be filled with water at the same temperature as the bath, which could not easily be achieved with the prior art water-filled pillows.

When bathtubs are not in use, the cushion(s) of the invention can remain in pleasantly expanded conventional shape and remain in bathtubs with their cases contributing beautiful color, pattern, shape and design. The skin-friendly covers are also key to further bath-takers' comfort.

Although the description above contains many specifics, these should not be construed as limiting the scope of the invention but as merely providing illustrations of some of the presently preferred embodiments of this invention. For example, the cushion device can have other shapes, fluid control ports can be mounted at various positions in various numbers, the spacing means can be formed integrally with the shell of the cushion, the fluid control ports or port fittings can also be formed integrally with said shell. Also, a shell can made in such a way, through blow molding, rotational molding, vacuum forming, injection molding, etc., that both said spacing means and said fluid control ports can be formed integrally with the shell, and the shell will stay expanded when not being used and being sufficiently flexible to support bathers' lumbar regions ergonomically when filled with water, or air, or mix of water and air. Fluid control ports can be closed by closure means such as plug-in caps, screw-on caps snap-on caps, flat sliding closures, rotational cylinder closures, etc. Furthermore said cushion device can be used to provide support to other parties or objects rather than human being alone. The way of operation of said cushion may vary as well.

Thus the scope of the invention should be determined by the appended claims and their legal equivalents, rather than by the examples given.

What is claimed is:

1. A cushion device for use when at least partially submerged in liquid of a confined basin or the like, comprising:

a flexible hollow, enclosed shell having a predetermined volume and shape, and having upper and lower ends, and being capable of containing liquid without substantial leakage, and a plurality of ports with at least one near upper end and at least one near lower end of said shell tat can allow gas or liquid fluid to enter into or to escape from said shell, said ports being provided with closures means which can substantially prevent entry and escape of gas or liquid from the shell, wherein said shell is also capable of maintaining the predetermined volume and shape when the shell is open to ambient air pressure, and said shell comprising means for maintaining the predetermined volume and shape when the shell is open to ambient air pressure.

2. The cushion device of claim 1 wherein said means for maintaining are firmness, rigidity or stiffness of the shell.

3. The cushion device according to claim 1, further comprising weight means tending to hold the lower end of said device down to the bottom of said basin during the initial filling process, and tending to hold the lower end of said device in a position below said upper end when the device is submerged or partially submerged.

4. The cushion device according to claim 1, wherein said means for maintaining are spacing means which maintain the predetermined volume when said ports are open to ambient air pressure.

5. The cushion device according to claim 4, wherein said spacing means is a structure comprising a plurality of cylinders made of mesh polymer material, said material allowing free flow of gas and liquid fluid between the outside and the inside of said cylinders.

6. The cushion device according to claim 1, wherein said ports include upper and lower ports arranged so that, when rising liquid fluid is filling the shell through at least one of the lower ports, gas fluid is being vented from at least one of the upper ports.

7. The cushion device according to claim 1, wherein said ports are mounted on said shell near both its upper and lower ends.

8. The cushion device according to claim 1 wherein said ports are formed integrally within said shell through a technology selected from the group consisting of blow molding, rotational molding, vacuum forming, or injection molding.

9. The cushion device according to claim 1, wherein said shell is a flexible container made of polymer material through a technology selected from the group consisting of heat sealing, welding, adhesive bounding, blow molding, rotational molding, vacuum forming, or injection molding.

10. A method for providing cushioning support under liquid in a confined basin or the like, comprising the steps of:

a) providing said device, in the form of a flexible hollow shell which is such as to maintain an expanded condition when its interior is open to ambient air or liquid pressure, said shell having a plurality of fluid control ports each provided with a closure means;

b) placing said device at the bottom of said basin when said basin is empty, with at least one of said plurality of fluid control ports near the upper end of said shell and at least one of said plurality of fluid control ports near the lower end of said shell, and with at least one upper and at least one lower said ports being kept open, c) filling said basin with liquid at a predetermined pace whereby said liquid enters said device automatically and simultaneously through at least one said port near the lower end of said device, while air is pushed out of said device through at least one said port near the upper end of said device, d) closing all said ports on said device once said basin is filled to a desired level, whereby said cushion device is ready for use to provide cushioning support.

* * * * *